US012018884B2

(12) United States Patent
Buchner et al.

(10) Patent No.: US 12,018,884 B2
(45) Date of Patent: Jun. 25, 2024

(54) REFRIGERATOR AND WATER STORAGE TANK FOR A REFRIGERATOR

(71) Applicant: WHIRLPOOL CORPORATION, Benton Harbor, MI (US)

(72) Inventors: Dilso Buchner, Joinville (BR); Shubhra Gupta, Pune (IN); Douglas Pohl, Benton Harbor, MI (US); Akshay Prajapati, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 125 days.

(21) Appl. No.: 17/950,388

(22) Filed: Sep. 22, 2022

(65) Prior Publication Data

US 2024/0102724 A1 Mar. 28, 2024

(51) Int. Cl.
*F25D 23/12* (2006.01)

(52) U.S. Cl.
CPC ..... *F25D 23/126* (2013.01); *F25D 2323/122* (2013.01)

(58) Field of Classification Search
CPC . F25D 2323/122; F25D 23/126; F25D 25/025
See application file for complete search history.

(56) References Cited

U.S. PATENT DOCUMENTS

| | | | |
|---|---|---|---|
| 9,915,468 | B2 | 3/2018 | You et al. |
| 10,718,563 | B2 | 6/2020 | Lee et al. |
| 2014/0283542 | A1* | 9/2014 | Jang ..... F25C 1/00 62/340 |

FOREIGN PATENT DOCUMENTS

| | | | |
|---|---|---|---|
| CN | 104534797 | A | 4/2015 |
| JP | S4858565 | U | 7/1973 |
| JP | S6059087 | U | 4/1985 |
| JP | 2003166781 | A | 6/2003 |
| JP | 4644699 | B2 | 3/2011 |
| JP | 2012229826 | A | 11/2012 |
| KR | 20050004398 | A | 1/2005 |
| KR | 20130017010 | A | 2/2013 |

* cited by examiner

*Primary Examiner* — Cassey D Bauer

(74) *Attorney, Agent, or Firm* — Brooks Kushman P.C.

(57) ABSTRACT

A refrigerator appliance includes a cabinet, a first side support, a second side support, a first adapter plate, a second adapter plate, and a water tank. The cabinet defines an internal cavity. The first and second side supports are disposed within the internal cavity, define a drawer receptacle therebetween, and have first and second laterally inward facing surfaces defining first and second longitudinally extending slots, respectively. The first and second longitudinally extending slots are configured to receive drawer rollers. The first and second adapter plates are secured to the first and second laterally inward facing surfaces, respectively, and have third and fourth laterally inward facing surfaces defining third and fourth longitudinally extending slots, respectively. The water tank is disposed within the drawer receptacle and slidably engages the third and fourth longitudinally extending slots such that the water tank is adjustable in a longitudinal direction.

20 Claims, 7 Drawing Sheets

REFRIGERATOR AND WATER STORAGE TANK FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a cabinet, a first side support, a second side support, a first adapter plate, a second adapter plate, and a water tank. The cabinet defines an internal cavity. The first and second side supports are disposed within the internal cavity, define a drawer receptacle therebetween, and define first and second slots, respectively. The first and second slots extend from a front to a rear of the internal cavity, face inward toward the drawer receptacle, and are configured to receive drawer rollers. The first adapter plate is secured to an internal side of the first side support plate and defines a third slot. The third slot extends from the front to the rear of the internal cavity and faces inward toward the drawer receptacle. The second adapter plate is secured to an internal side of the second side support plate and defines a fourth slot. The fourth slot extends from the front to the rear of the internal cavity and faces inward toward the drawer receptacle. The water tank has first and second support rails. The first and second support rails protrude outward from first and second sides of the water tank, respectively, and are disposed within the third and fourth slots, respectively. A position of the water tank is adjustable in a direction extending between the front and the rear of the internal cavity via the first and second support rails sliding within the third and fourth slots, respectively.

A refrigerator appliance includes a cabinet, a first side support, a second side support, a first adapter plate, a second adapter plate, and a water tank. The cabinet defines an internal cavity. The first and second side supports are disposed within the internal cavity, define a drawer receptacle therebetween, and have first and second laterally inward facing surfaces defining first and second longitudinally extending slots, respectively. The first and second longitudinally extending slots are configured to receive drawer rollers. The first and second adapter plates are secured to the first and second laterally inward facing surfaces, respectively, and have third and fourth laterally inward facing surfaces defining third and fourth longitudinally extending slots, respectively. The water tank is disposed within the drawer receptacle and slidably engages the third and fourth longitudinally extending slots such that the water tank is adjustable in a longitudinal direction.

A refrigerator appliance includes a cabinet, side supports, adapters, and a water tank. The cabinet defines an internal cavity. The side supports disposed within the internal cavity, define a drawer receptacle, and define a first set of slots. The adapters are secured to the side supports and defining a second set of slots. The water tank is disposed within the drawer receptacle and slidably engages the second set of slots via a tongue and groove engagement such that the water tank is adjustable between a front and a back of the internal cavity.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
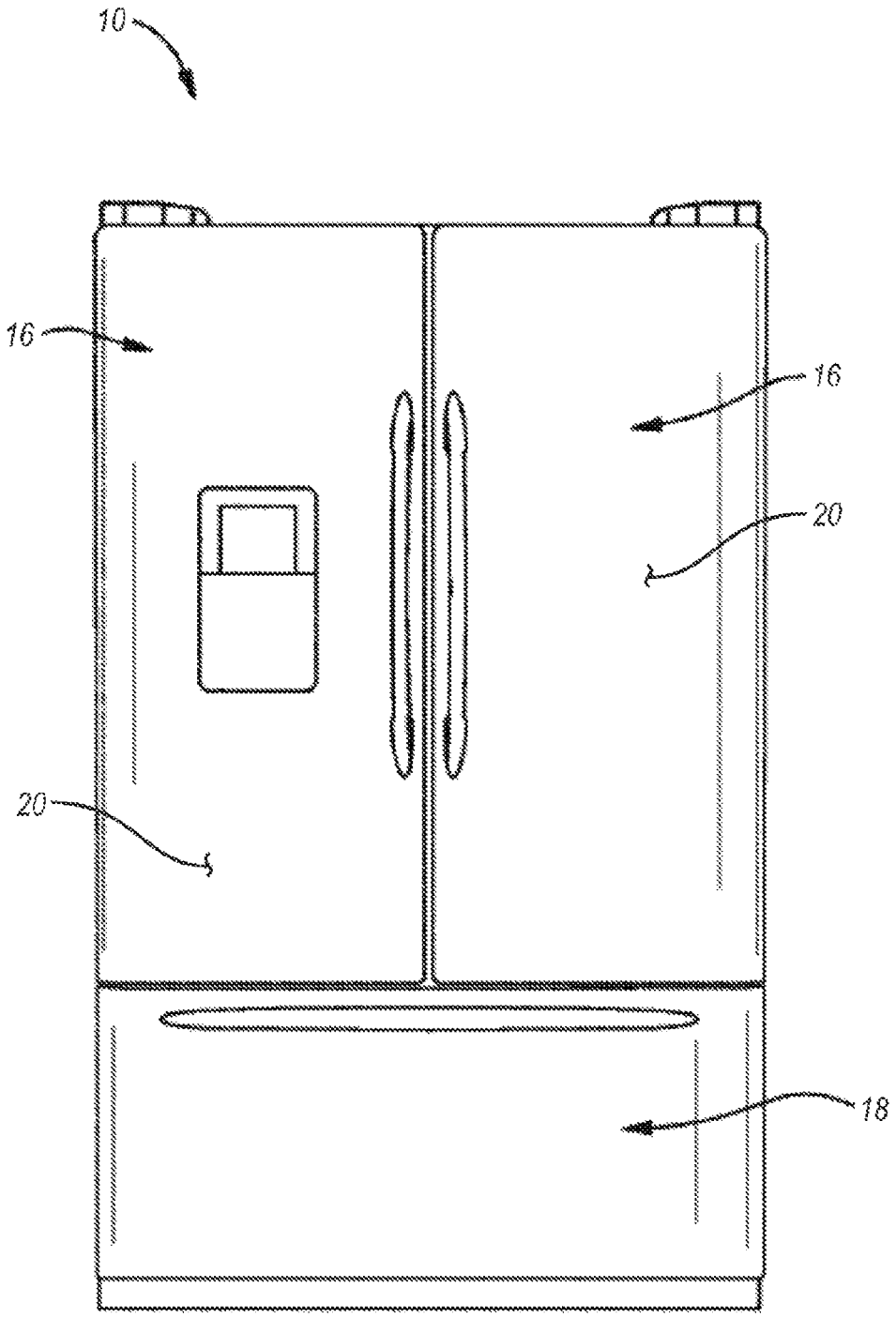
FIG. 1 is an elevated front view of a French-Door Bottom Mount type refrigerator appliance.
Figure 2:
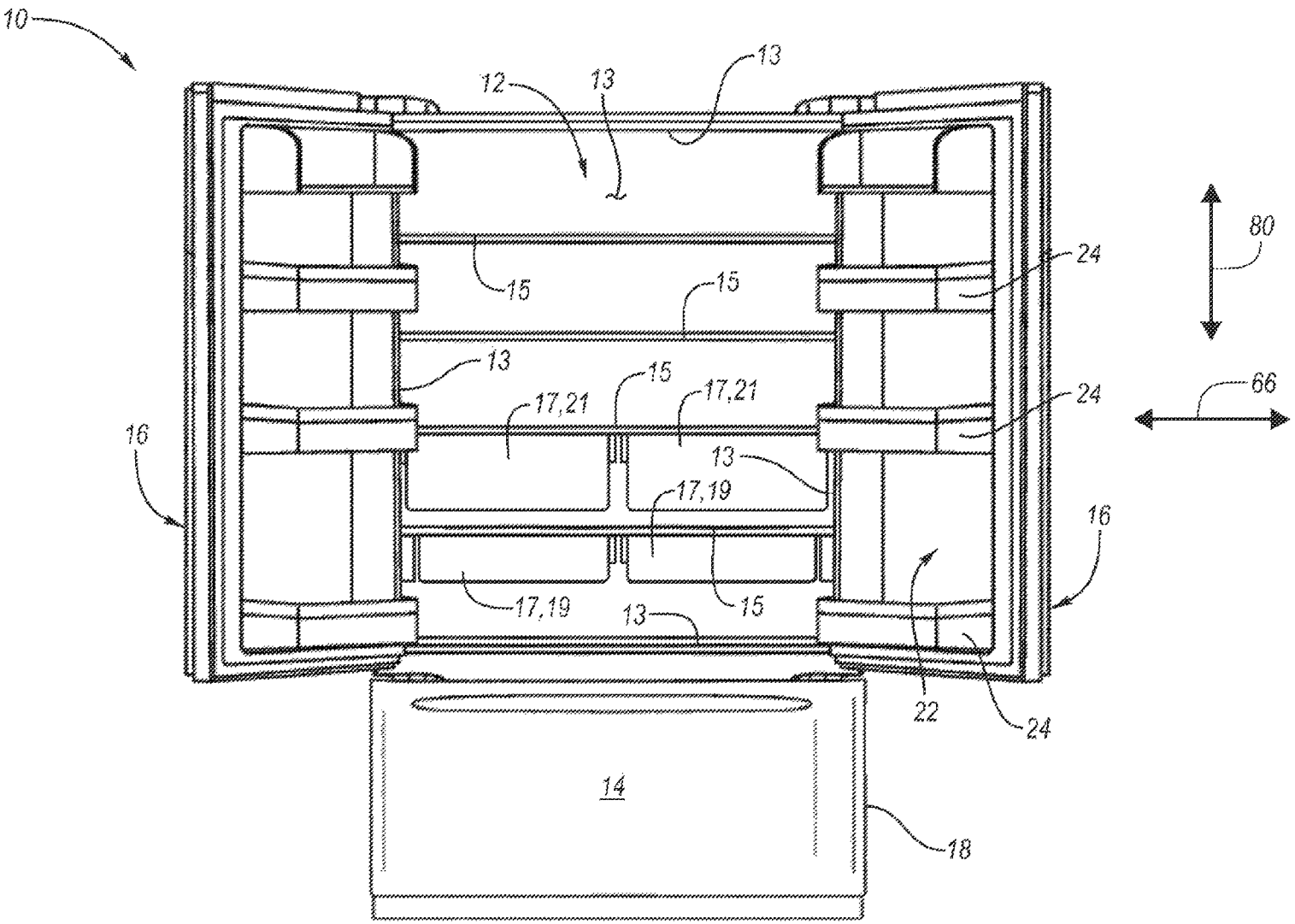
FIG. 2 is an elevated front view of a French-Door Bottom Mount type refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber, first internal cavity, or fresh food compartment 12 configured to refrigerate and not freeze consumables within the fresh food compartment 12. The refrigerator 10 may also have a second internal storage chamber, second internal cavity, or a freezer compartment 14 configured to freeze consumables within the freezer compartment 14 during normal use. The refrigerator 10 includes panels or walls 13 that form a housing or cabinet. The housing or cabinet, or more specifically the walls 13, define the fresh food compartment 12 and the freezer compartment 14. The walls 13 may more specifically form an internal liner of the refrigerator 10. The walls 13 may include a rear or back wall, a top wall, a bottom wall, and two side walls.

One or more shelves 15 may be secured to the walls 13 within the fresh food compartment 12. One or more drawers 17 may be slidably secured to the shelves 15 or the walls within the fresh food compartment 12. More specifically, the drawers 17 may be slidably secured to the shelves 15 or the walls within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Figure 3:
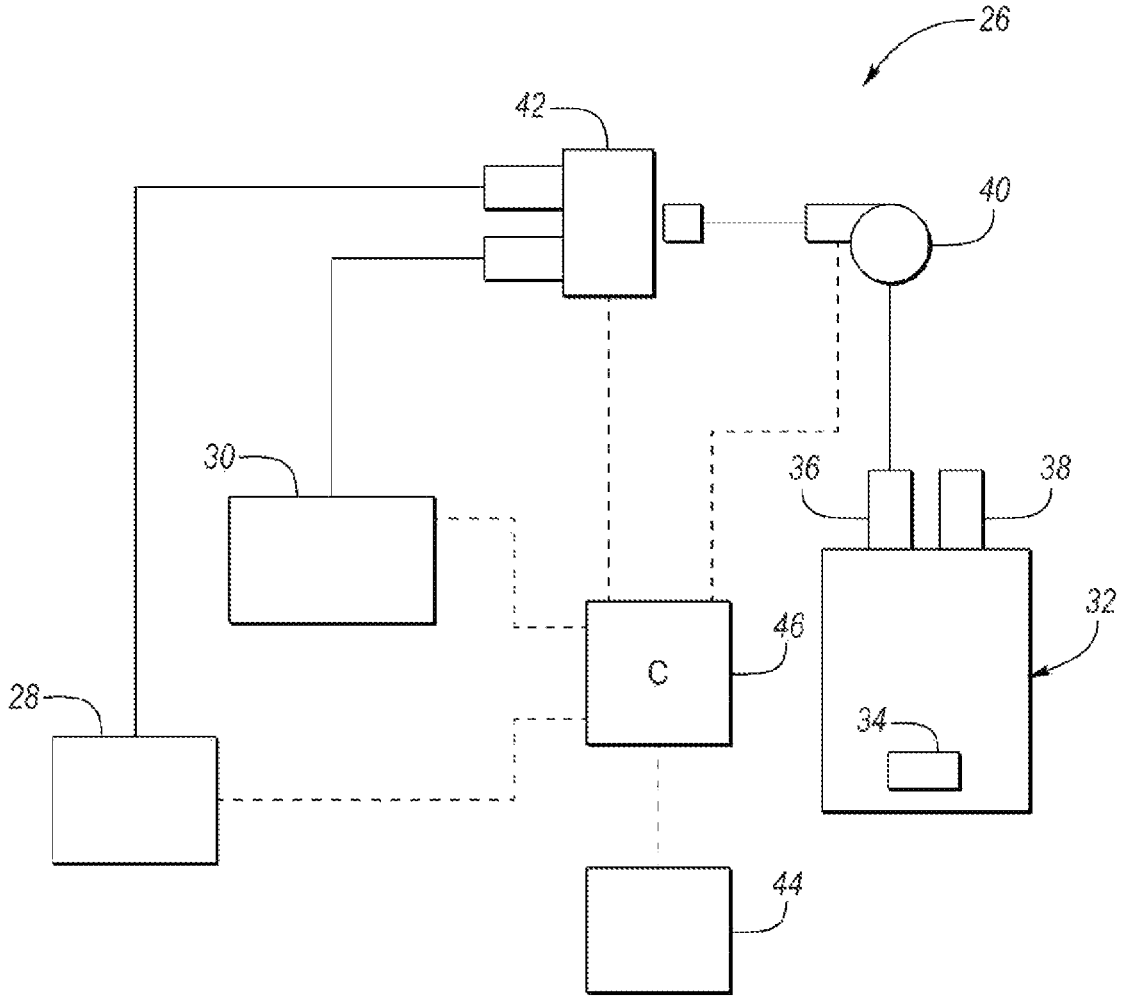
FIG. 3 is a schematic illustration of a water system for the refrigerator and a corresponding control system for the water system.
Figure 4:
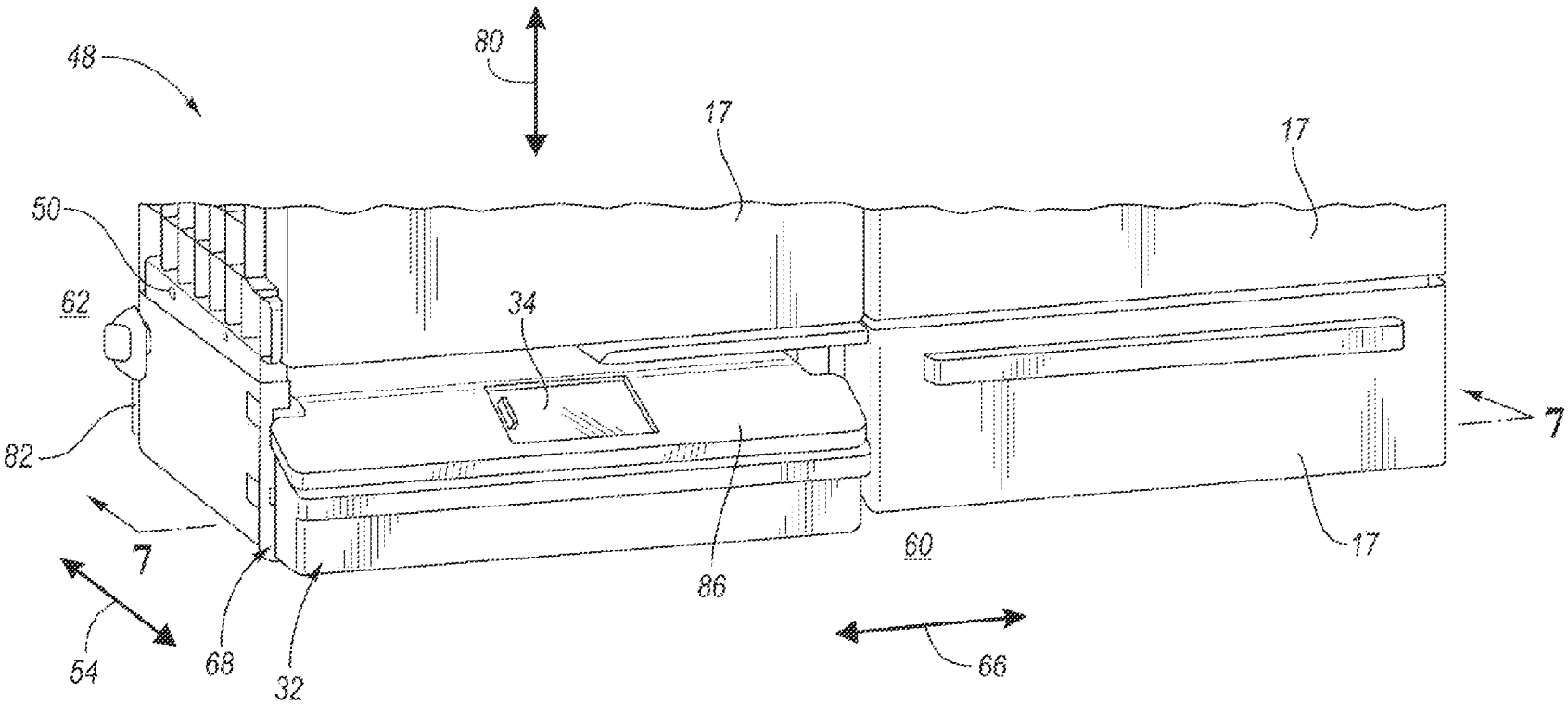
FIG. 4 is a partial isometric view of a drawer arrangement for the refrigerator with a water tank for the water system disposed within one of a plurality of drawer receptacles.
Figure 5:
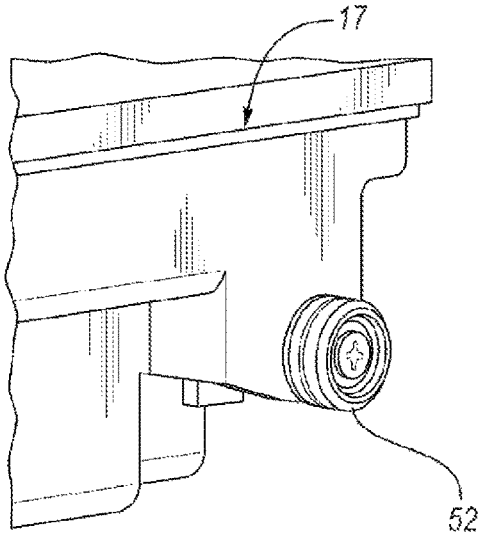
FIG. 5 is a partial isometric view of a drawer.
Figure 6:
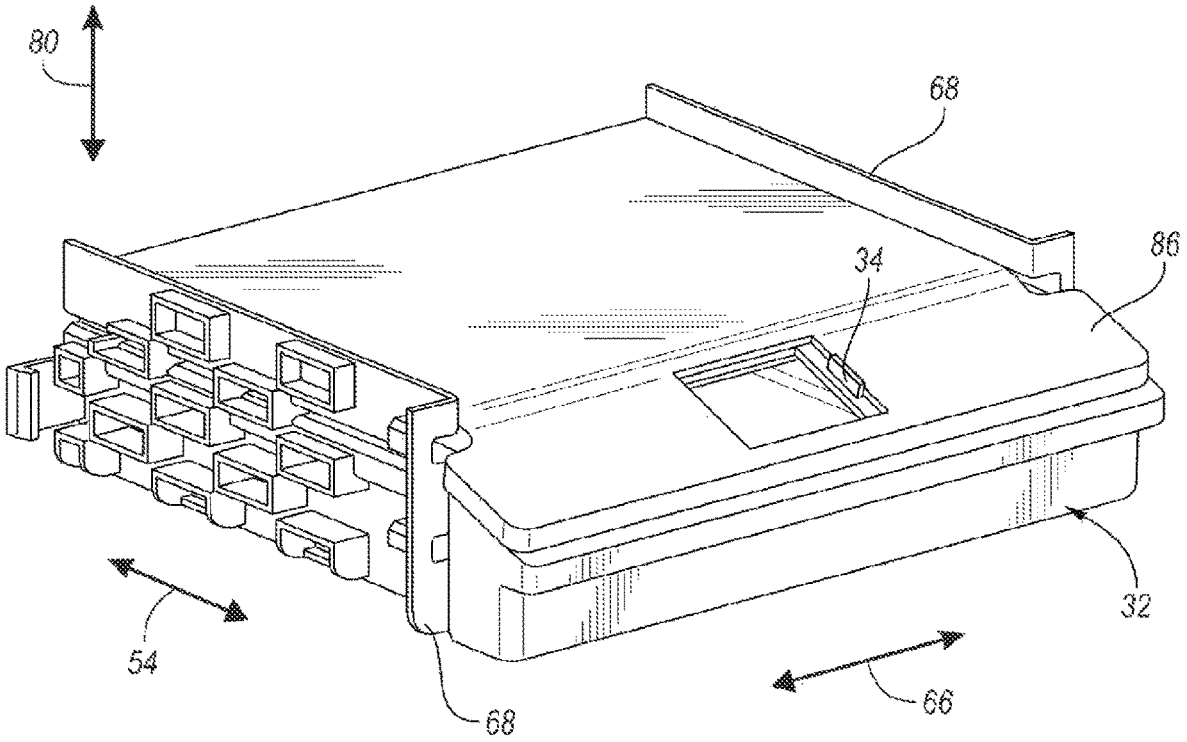
FIG. 6 is an isometric view of the water tank engaging a pair of adapter plates.
Figure 7:
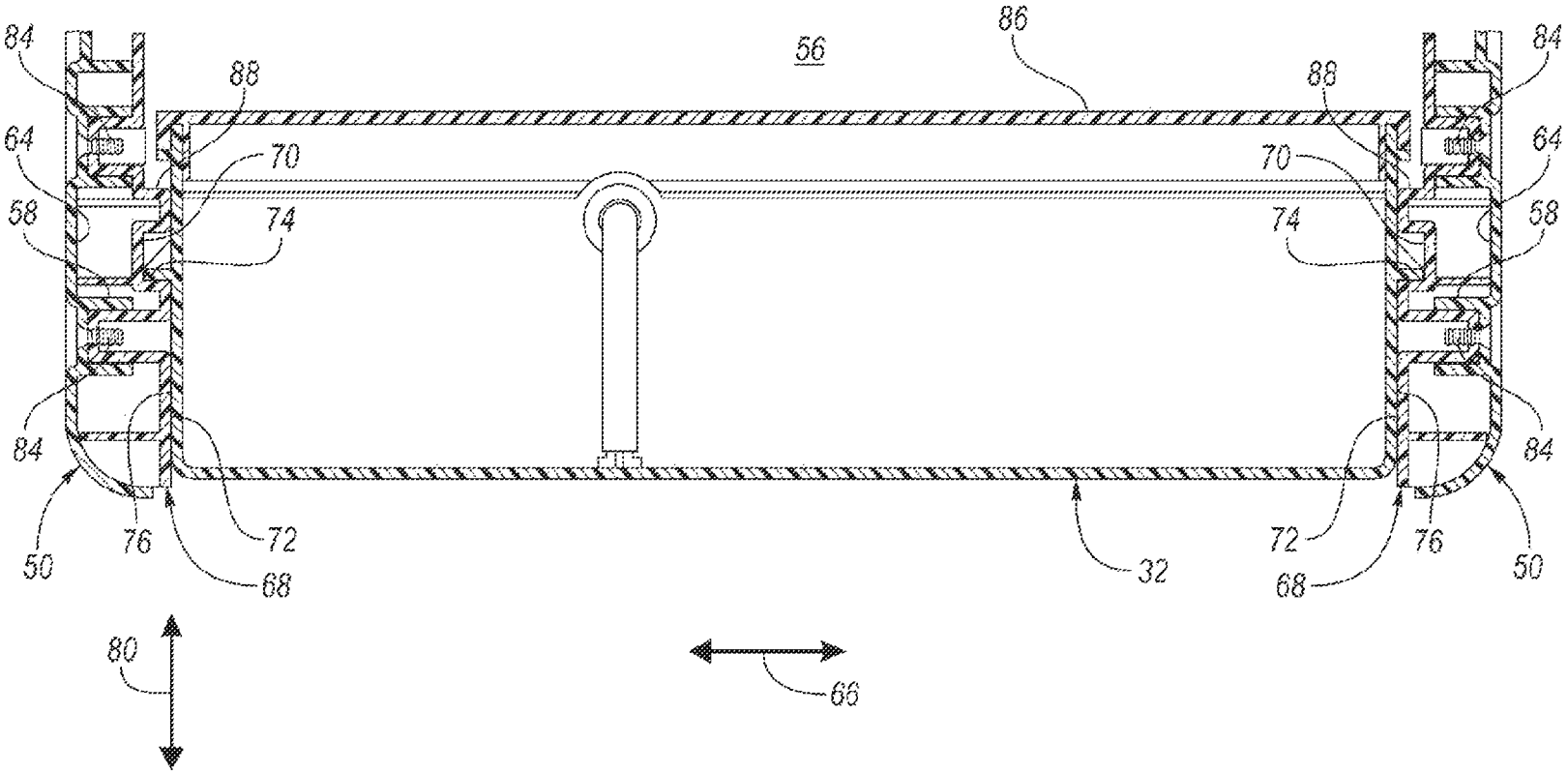
FIG. 7 is a cross-sectional view taken along line 7-7 in FIG. 4.
Figure 8:
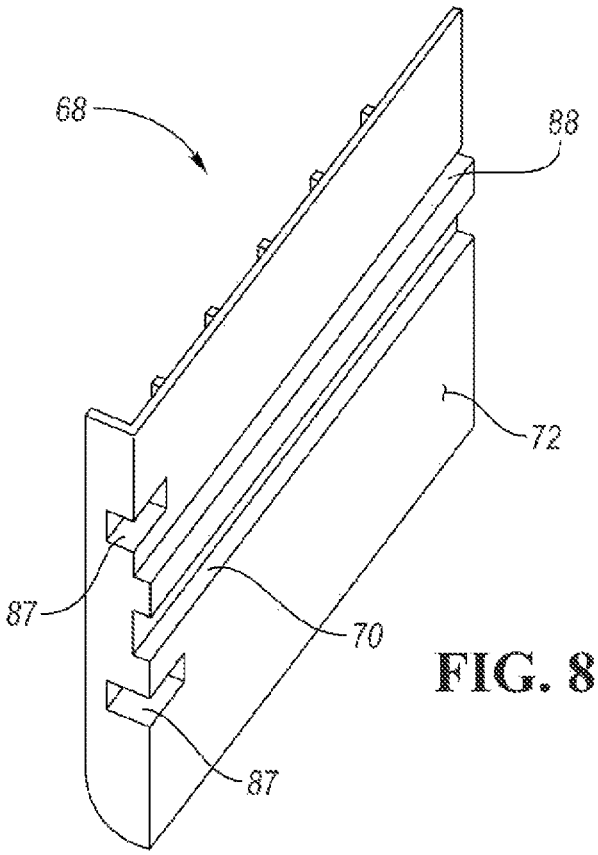
FIG. 8 is a front isometric view of one of the adapter plates.
Figure 9:
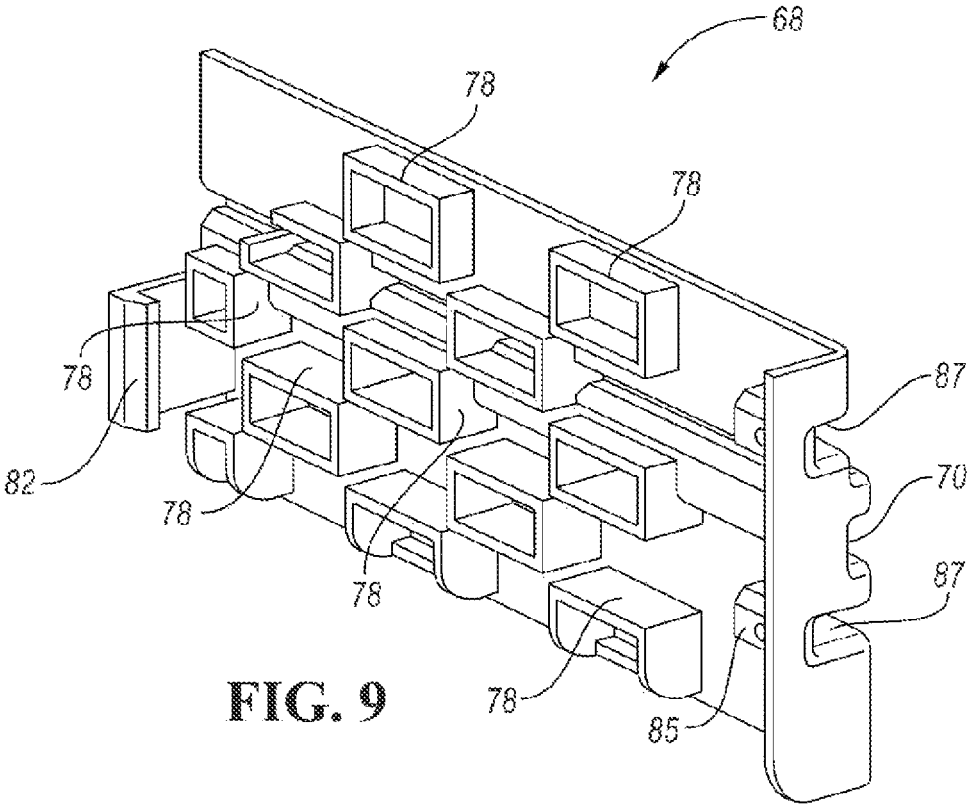
FIG. 9 is a rear isometric view of one of the adapter plates.

Referring to FIG. 3, the refrigerator 10 may also have a water system 26 that delivers water to a water dispenser 28 and to an ice maker 30. The water system 26 includes a water container or water tank 32. The water tank 32 may be disposed within the fresh food compartment 12. That water tank 32 may include a cover 34 that may transition from a closed position to an opened position to provide access to the internal of the water tank 32 so that the water tank 32 may be manually filled. The water within the water tank 32 may be delivered to either the water dispenser 28 or ice maker 30 via an outlet port 36 of the water tank 32. The water tank 32 may also include a breather port 38 to allow air to flow into the water tank 32 as water is being directed out of the water tank 32 via the outlet port 36 so that the pressure within the water tank 32 main remain constant or relatively constant (e.g., the pressure within the water tank 32 may remain at approximately atmospheric pressure with minor variations).

A pump 40 may be configured deliver water to either the water dispenser 28 or the ice maker 30. A valve 42 may be configured to divert the water to either the water dispenser 28 or the ice maker 30. A user may request that the water dispenser 28 dispense water via a user interface 44. The user interface 44 may communicate with a controller 46 that operates the pump 40 and valve 42 to dispense water from the water dispenser 28. The ice maker 30 may be configured to store ice within a bin. The ice may then be dispensed in response to a user request to dispense ice via a user interface 44. An ice dispenser may be located proximate to the water dispenser 28. The controller 46 may operate the ice dispenser to dispense ice in response to the user request to dispense ice via the user interface 44. A quantity of ice that is disposed within the ice bin may be communicated to the controller 46. The controller 46 may be configured to operate the pump 40 and valve 42 to direct water to the ice maker 30 to make ice in response to quantity of ice that is disposed within the ice bin decreasing to less than a threshold. The quantity of ice that is disposed within the ice bin may be tracked based on a comparison of an amount of ice that has been made relative to an amount of ice that has been dispensed. Alternatively, a sensor may be utilized to detect the level of ice within the ice bin and may communicate the level of ice within the ice bin to the controller 46. If the level is less than a threshold, the controller 46 may operate the valve 42 to direct water to the ice maker 30 to make ice.

Controller 46 may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller 46 may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 46 in controlling the refrigerator 10.

Control logic or functions performed by the controller 46 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based controller, such as controller 46. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer. The computer-readable storage devices or media may include one or more of a number of known physical devices which utilize electric, magnetic, and/or optical storage to keep executable instructions and associated calibration information, operating variables, and the like.

Referring to FIGS. 4-9, a drawer arrangement 48 and an adapter system for securing the water tank 32 to the drawer arrangement 48 is illustrated. The drawer arrangement 48 may include any of the drawers 17 that are illustrated in FIG. 2. For example, the drawer arrangement 48 may comprise the two pantry drawers 19 and crisper drawers 21 illustrated in FIG. 2. However, the drawer arrangement 48 may be representative of a drawer arrangement comprising any number or type of drawers. One of the existing drawers has been removed and replaced by the water tank 32. The drawer arrangement 48 and all the elements illustrated in FIGS. 4-9, including the water tank 32, may be disposed within either the fresh food compartment 12 or the freezer compartment 14. The drawer arrangement 48 may include side supports 50 that are adapted to receive rollers 52 that are secured to the drawers 17. The drawers 17 may be configured to slide forward into and rearward out of the refrigerator 10 (e.g., into and out of either the fresh food compartment 12 or the freezer compartment 14) via the rollers 52. Such forward and rearward movement maybe referred to as movement in a longitudinal direction 54. The longitudinal direction 54 may correspond to a direction into and out of the paper or pages in FIGS. 1 and 2 (i.e., in a direction that is perpendicular to the depicted in FIGS. 1 and 2).

The side supports 50 may include a pair of spaced apart side supports, which may be referred to as the first and second side supports. Such first and second side supports may be mirror images of each other. A drawer receptacle 56 may be defined by and between the side supports 50. The side supports 50 define slots 58 that are configured to receive the drawer rollers 52. The slots 58 may be referred to as the first and second slots or as the first set of slots where each side support 50 defines one of the slots 58. The slots 58 extend longitudinally (e.g., in the longitudinal direction 54) from a front 60 to a rear 62 of an internal cavity (e.g., the fresh food compartment 12 or the freezer compartment 14) and face inward toward the drawer receptacle 56. More specifically, each of the side supports 50 have laterally inward facing surfaces 64 that define one of the slots 58. The laterally inward facing surfaces 64 that face inward in a lateral direction 66 toward the drawer receptacle 56 and may be referred to as the first and second laterally inward facing surfaces. The lateral direction 66 may correspond to a direction extending from the right to the left of the refrigerator 10 when facing a front of the refrigerator (i.e., in a direction that extends from the left side to the right side of the images depicted in FIGS. 1 and 2).

Adapter plates 68 are secured to internal sides, or more specifically to the laterally inward facing surfaces 64, of each of the side supports 50. The adapter plates 68 may include a pair of spaced apart adapter plates, which may be referred to as the first and second adapter plates. Such first and second adapter plates may be mirror images of each other. The adapter plates 68 define slots 70. The slots 70 may be referred to as the third and fourth slots or as the second set of slots where each adapter plate 68 defines one of the slots 70. The slots 70 extend longitudinally (e.g., in the longitudinal direction 54) from a front 60 to a rear 62 of the internal cavity (e.g., the fresh food compartment 12 or the freezer compartment 14) and face inward toward the drawer receptacle 56. More specifically, each of the adapter plates 68 have laterally inward facing surfaces 72 that define one of the slots 70. The laterally inward facing surfaces 72 face inward in the lateral direction 66 toward the drawer receptacle 56 and may be referred to as the third and fourth laterally inward facing surfaces.

The water tank 32 is disposed within one of the drawer receptacles 56. The water tank 32 slidably engages the slots 70 such that the water tank 32 is adjustable in the longitudinal direction 54 between the front 60 and the rear 62 of the internal cavity (e.g., the fresh food compartment 12 or the freezer compartment 14). The water tank 32 includes support rails 74 that protrude laterally outward (e.g., in the lateral direction 66) from lateral walls or sides 76 of the water tank 32 and extend longitudinally (e.g., in the longitudinal direction 54) between the front 60 and the rear 62 of the internal cavity (e.g., the fresh food compartment 12 or the freezer compartment 14). More specifically, the water tank 32 may include two lateral side walls or sides and one of the support rails 74 may protrude laterally outward from each of the lateral sides 76. The two lateral sides 76 may be referred to as first and second side and the support rails 74 that protrude laterally outward from each lateral side may be referred to as first and second support rails. Each support rail 74 may be disposed within one of the slots 70.

The support rails 74 may provide support to maintain the position of the water tank 32 within the drawer receptacle 56 and may engage the adapter plates 68 via a sliding or friction engagement within the slots 70 such that the position of the water tank 32 is adjustable in the longitudinal direction 54 between the front 60 and the rear 62 of the internal cavity (e.g., the fresh food compartment 12 or the freezer compartment 14) via the support rails 74 sliding within the slots 70. This may be referred to as a tongue and groove engagement. The engagement between the support rails 74 and the slots 70 will have sufficient clearance between the support rails 74 and the slots 70 such that support rails 74 may slide within the slots 70. Such sufficient clearance may more specifically refer to the clearance between the support rails 74 and the adapter plates 68 along the tops and laterally outward edges (i.e., outward edges in the lateral direction 66) of the slots 70.

Each adapter plate 68 may includes blocks 78 that extend outward and into the slots 58 defined by the corresponding side supports 50 that each adapter plates 68 is secured to. Engagement between the blocks 78 and the slots 58 may operate to locate the adapter plates 68 in a desired position with respect to a vertical direction 80 (e.g., disposing the blocks 78 within the slots 58 may prevent relative movement between the adapter plates 68 and the corresponding side supports 50 in the vertical direction 80). Some of the blocks 78 may engage additional grooves, notches, or slots defined by the side supports 50 other than slots 58.

The adapter plates 68 may include clips 82 that protrude outward therefrom. More specifically, the clips 82 may protrude laterally outward (e.g., outward in the lateral direction 66) from rear or back sides of the adapter plates 68 proximate to the rear 62 of the internal cavity (e.g., the fresh food compartment 12 or the freezer compartment 14). The clips 82 are configured to engage rear or back sides of the corresponding side supports 50 to secure the adapter plates 68 to the corresponding side supports 50 via a snap-fit engagement. For example, the clips 82 may be hook-shaped, may be configured to flex during installation, and may be configured to snap into a secured position once installation is completed in order to secure the adapter plates 68 the corresponding side supports 50.

Fasteners 84 may further secure the adapter plates 68 to the corresponding side supports 50. The fasteners 84 may extend laterally (e.g., in the lateral direction 66) from the corresponding side supports 50 to the adapter plates 68 along front sides of the adapter plates 68 proximate to the front 60 of the internal cavity (e.g., the fresh food compartment 12 or the freezer compartment 14). The fasteners 84 may be counter-sunk fasteners and the side supports 50 may define counter-sunk orifices that receive the fasteners 84 such that the heads of the fasteners 84 do not interfere with the other components of the refrigerator 10. The engagement between the adapter plates 68 and the corresponding side supports 50 via the clips 82 and the fasteners 84 may operate to locate the adapter plates 68 in a desired position with respect to longitudinal direction 54 and the lateral direction 66 (e.g., the clips 82 and fasteners 84 may prevent relative movement between the adapter plates 68 and the corresponding side supports 50 in the longitudinal direction 54 and the lateral direction 66).

The fasteners 84 may engage projections 85 on the adapter plates 68 that are recessed laterally outward (e.g., outward in the lateral direction 66) from the laterally inward facing surfaces 72 of the adapter plates 68 so that the fasteners 84 do not interfere with the sliding movement of the water tank 32 in the longitudinal direction 54 with respect to the adapter plates 68. Corresponding notches 87 may be defined on along the laterally inward facing surfaces 72 of the adapter plates 68 that correspond to the projections 85 on the adapter plates 68.

The water tank 32 may further include a lid 86. The cover 34 may be slidably secured to the lid 86 so that the cover 34 may transition between a closed position (e.g., FIG. 4) and an open position (e.g., FIG. 6). The laterally inward facing surfaces 72 of the adapter plates 68 may define recesses or slots 88 that provide clearance for the lid 86. The slots 88 may be referred to as the fifth and six slots or as the third set of slots where each adapter plate 68 defines one of the slots 88. The slots 88 extend longitudinally (e.g., in the longitudinal direction 54) from a front 60 to a rear 62 of the internal cavity (e.g., the fresh food compartment 12 or the freezer compartment 14) and face inward toward the drawer receptacle 56. The slots 88 are disposed above the slots 70 that receive the support rails 74.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet defining an internal cavity;

first and second side supports (i) disposed within the internal cavity, (ii) defining a drawer receptacle therebetween, and (iii) defining first and second slots, respectively, wherein the first and second slots (a) extend from a front to a rear of the internal cavity, (b) face inward toward the drawer receptacle, and (c) are configured to receive drawer rollers;

a first adapter plate (i) secured to an internal side of the first side support plate and (ii) defining a third slot, wherein the third slot (a) extends from the front to the rear of the internal cavity and (b) faces inward toward the drawer receptacle;

a second adapter plate (i) secured to an internal side of the second side support plate and (ii) defining a fourth slot, wherein the fourth slot (a) extends from the front to the rear of the internal cavity and (b) faces inward toward the drawer receptacle; and a water tank having first and second support rails, the first and second support rails (i) protruding outward from first and second sides of the water tank, respectively, and disposed within the third and fourth slots, respectively, wherein a position of the water tank is adjustable in a direction extending between the front and the rear of the internal cavity via the first and second support rails sliding within the third and fourth slots, respectively.

2. The refrigerator appliance of claim 1, wherein the first and second adapter plates have blocks that extend outward and into the first and second slots, respectively.

3. The refrigerator appliance of claim 1, wherein (i) the first and second adapter plates have clips protruding outward therefrom, and (ii) the first and second adapter plates are secured to the first and second side supports, respectively, via the clips.

4. The refrigerator appliance of claim 3, wherein the clips engage the first and second side supports via a snap-fit engagement.

5. The refrigerator appliance of claim 3 further comprising fasteners to further secure the first and second adapter plates to the first and second side supports.

6. The refrigerator appliance of claim 5, wherein (i) the clips protrude outward from rear sides of the first and second adapter plates proximate to the rear of the internal cavity and (ii) the fasteners engage front sides of the first and second adapter plates proximate to the front of the internal cavity.

7. The refrigerator appliance of claim 1, wherein the (i) water tank includes a lid and (ii) the first and second adapter plates define fifth and six slots, respectively, that provide clearance for the lid.

8. A refrigerator appliance comprising:

a cabinet defining an internal cavity;

first and second side supports (i) disposed within the internal cavity, (ii) defining a drawer receptacle therebetween, and (iii) having first and second laterally inward facing surfaces defining first and second longitudinally extending slots, respectively, wherein the first and second longitudinally extending slots are configured to receive drawer rollers;

first and second adapter plates (i) secured to the first and second laterally inward facing surfaces, respectively, and (ii) having third and fourth laterally inward facing surfaces defining third and fourth longitudinally extending slots, respectively; and a water tank (i) disposed within the drawer receptacle and (ii) slidably engaging the third and fourth longitudinally extending slots such that the water tank is adjustable in a longitudinal direction.

9. The refrigerator appliance of claim 8, wherein the first and second adapter plates have first and second longitudinally extending support rails (i) protruding outward from first and second laterally outward facing surfaces of the water tank, respectively, (ii) disposed within the third and fourth longitudinally extending slots, respectively, and (iii) configured to slide within the third and fourth longitudinally extending slots, respectively to adjust a position of the water tank in the longitudinal direction.

10. The refrigerator appliance of claim 8, wherein the first and second adapter plates have blocks that extend outward and into the first and second longitudinally extending slots, respectively.

11. The refrigerator appliance of claim 8, wherein (i) the first and second adapter plates have clips protruding outward therefrom, and (ii) the first and second adapter plates are secured to the first and second side supports, respectively, via the clips.

12. The refrigerator appliance of claim 11, wherein the clips engage the first and second side supports via a snap-fit engagement.

13. The refrigerator appliance of claim 11 further comprising fasteners to further secure the first and second adapter plates to the first and second side supports.

14. The refrigerator appliance of claim 13, wherein (i) the clips protrude outward from rear sides of the first and second adapter plates and (ii) the fasteners engage front sides of the first and second adapter plates.

15. The refrigerator appliance of claim 8, wherein the (i) water tank includes a lid and (ii) the third and fourth laterally inward facing surfaces define fifth and six longitudinally extending slots, respectively, that provide clearance for the lid.

16. The refrigerator appliance of claim 15, wherein the fifth and six longitudinally extending slots are disposed above the third and fourth longitudinally extending slots.

17. A refrigerator appliance comprising:

a cabinet defining an internal cavity;

side supports (i) disposed within the internal cavity, (ii) defining a drawer receptacle, and (iii) defining a first set of slots;

adapters (i) secured to the side supports and (ii) defining a second set of slots; and a water tank (i) disposed within the drawer receptacle and (ii) slidably engaging the second set of slots via a tongue and groove engagement such that the water tank is adjustable between a front and a back of the internal cavity.

18. The refrigerator appliance of claim 17, wherein the adapters have blocks that extend outward and into the first set of slots.

19. The refrigerator appliance of claim 17, wherein (i) the adapters have clips protruding outward therefrom, and (ii) the adapters are secured to the side supports via the clips via a snap-fit engagement.

20. The refrigerator appliance of claim 19 further comprising fasteners to further secure the adapters to the side supports.

* * * * *